US007341402B1

(12) United States Patent
Schroeder

(10) Patent No.: US 7,341,402 B1
(45) Date of Patent: Mar. 11, 2008

(54) BARRIER PANEL

(76) Inventor: Mark Schroeder, Sandmound Blvd., Oakley, CA (US) 94561

( * ) Notice: Subject to any disclaimer, the term of this patent is extended or adjusted under 35 U.S.C. 154(b) by 0 days.

(21) Appl. No.: 11/099,202

(22) Filed: Apr. 4, 2005

(51) Int. Cl.
*E02D 5/02* (2006.01)

(52) U.S. Cl. ..... 405/107; 405/274

(58) Field of Classification Search ..... 405/107, 405/110, 111, 116, 274
See application file for complete search history.

(56) References Cited

U.S. PATENT DOCUMENTS 6,568,881 B2 * 5/2003 Long ..... 405/248
2005/0163575 A1 * 7/2005 Dagher et al. ..... 405/274

OTHER PUBLICATIONS

*U.S. Army Corp [sic] of Engineers, Reed & Reed Construction, and Crane Materials International Help Restore Harbor*; http://www.cmilc.com/company/news/press23.htm; published Jan. 12, 2005.

* cited by examiner

*Primary Examiner*—Tara L. Mayo
(74) *Attorney, Agent, or Firm*—Fliesler Meyer LLP

(57) ABSTRACT

A levee barrier panel to form a levee retaining wall has a top and a bottom and a plurality of apertures extending from the top to the bottom of the levee barrier panel. A cutter tool extends through to the bottom of each panel to transform the levee composition into a slush whereby a vacuum removably attached to the aperture sucks out the slush thereby forming an opening in the levee. The levee barrier panel is then lowered into the opening.

22 Claims, 4 Drawing Sheets

BARRIER PANEL

FIELD OF THE INVENTION

The present invention relates to barrier panels. More particularly, the present invention relates to barrier panels to stabilize levees.

BACKGROUND OF THE INVENTION

Levees provide protection from flooding in communities, including industrial, commercial, residential, and agricultural communities. However, should a levee break, extreme damage to the surrounding communities can occur. Levee failures can result from erosion, slides within the levee embankment or the foundation soil, or from animals burrowing into the levee. For example, when beavers dug into a levee in the California Delta, crops and farm communities were flooded with water. Damages and cleanup costs were estimated at $90 million dollars.

Farming on the lands also scrapes away layers of soil, gradually pushing the land below sea level in a process called subsidence. As the land falls below sea level, additional pressure is placed on the levees to control flooding of the lands. Continual subsidence occurs due to ongoing soil placement on the levees in order for the levee elevation to be maintained. This additional soil placement causes increased loading of the toe of the existing levees inducing potential failure of the levee.

Should multiple levees collapse from tidal fluctuations or seismic events, farms, homes and crops would be flooded, and rail lines, gas pipelines and aqueducts could be damaged. Water quality may even be significantly compromised and the ecosystem of neighboring plants and animals may be endangered.

To maintain levees, the current practice on the water side is to buttress the slope with soil and rock, called riprap, to protect the levee against buffeting by wind-whipped waves and the force of winter high tidal conditions. However, the rocks and soil add weight to the levee, which causes the levee to subside. This repeated addition of rocks or soil every few years exacerbates subsidence and increases maintenance costs to governmental agencies.

Alternative measures used to reinforce levees are Fiberglass Reinforced Polymer (FRP) sheet piling. However, the FRP must be put into levees using vibratory hammers, or dynamically driven using a removable mandrill. Unfortunately, most levees are built in flood prone areas or of basic compressible soil that was laid down in a stratified manner. The introduction of water pressure through the layered soil reduces the levee strength making it susceptible to failure from strong vibrations. Furthermore, homes built next to the levees may become damaged due to the vibrations because they too were constructed over vibrationally sensitive soil.

Levees may also be reinforced with steel, concrete, or cement barriers. These types of installations would require the use of vibrational or hydraulic driving equipment. In general, large heavy equipment must be used to install these types of barrier systems. In many cases, the levees are unable to support the additional equipment loads and accessibility on the levees is typically limited. All of which serves to increase the expense of installing barriers in levees. Furthermore, these barriers may be prone to corrosion with the exception of concrete. All of these barriers are labor intensive during installation. In addition, these barrier systems require heaving installation equipment, limiting the accessibility on the levee.

BRIEF DESCRIPTION OF THE INVENTION

A levee barrier panel to form a levee retaining wall has a top and a bottom and a plurality of apertures extending from the top to the bottom of the levee barrier panel. A cutter tool extends through to the bottom of each panel to transform the levee composition into a slush whereby a vacuum removably attached to the aperture sucks out the slush thereby forming an opening in the levee. The levee barrier panel is then lowered into the opening.

BRIEF DESCRIPTION OF THE DRAWINGS

The accompanying drawings, which are incorporated into and constitute a part of this specification, illustrate one or more embodiments and, together with the detailed description, serve to explain the principles and implementations of the invention.

In the drawings.

DETAILED DESCRIPTION

Embodiments are described herein in the context of a levee barrier panel. Those of ordinary skill in the art will realize that the following detailed description is illustrative only and is not intended to be in any way limiting. Other embodiments of the present invention will readily suggest themselves to such skilled persons having the benefit of this disclosure. Reference will now be made in detail to implementations of the present invention as illustrated in the accompanying drawings. The same reference indicators will be used throughout the drawings and the following detailed description to refer to the same or like parts.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Figure 1B:
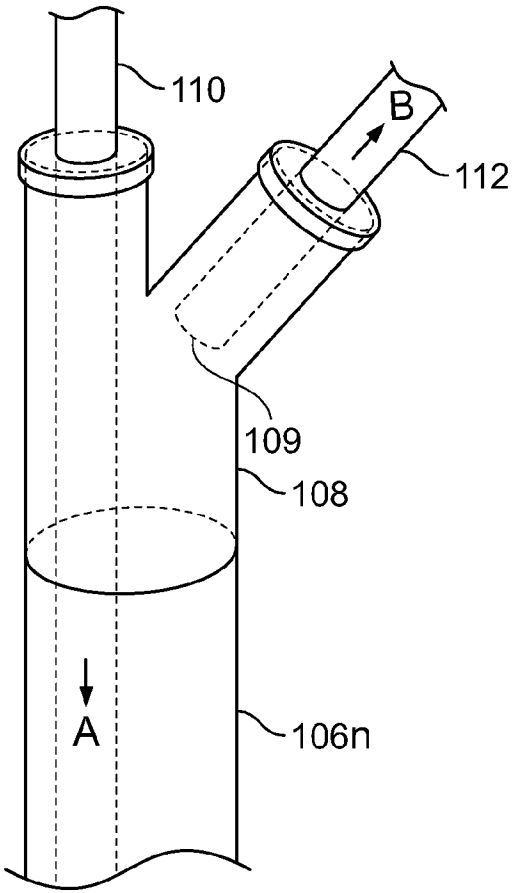
FIGS. 1A and 1B illustrate an embodiment of a levee barrier panel.
Figure 1A:
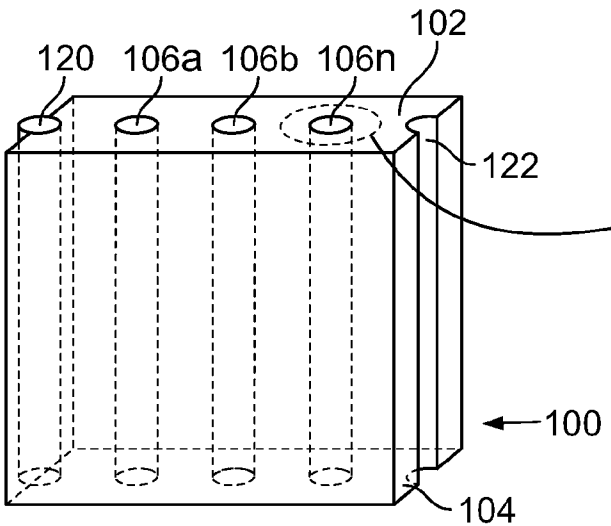

The invention relates to barrier panels to stabilize levees. FIGS. 1A and 1B illustrate an embodiment of a levee barrier panel. The panel, generally numbered 100, comprises a top 102 and a bottom 104, and a plurality of apertures 106*a*, 106*b*, 106*n* (where n is an integer) extending from the top 102 to the bottom 104 of the levee barrier panel 100.

A side attachment member 120 and corresponding side mating member 122 allows several levee barrier panels to be connected to each other to form the levee retaining wall. Furthermore, the side attachment member 120 and corresponding side mating member 122 may be beveled to allow the panels to be positioned at any angle necessary to provide for rigidity, surface obstructions, or surface changes in the levee.

The panel 100 may be made from any strong material such as concrete, steel, and the like. Although illustrated in a generally rectangular shape, the panel may be formed in any shape necessary as further described below with reference to FIG. 3.

As better illustrated in FIG. 1A, the panel 100 may have a connector 108 extending out of the aperture 106*n*. Although only one connector 108 is illustrated, it will be appreciated that connectors may extend out of all the apertures 106*a*, 106*b*. The connector 108 may be made out of any material such as plastic, steel, metal, and the like. The connector 108 illustrated in FIG. 1B is a Y-connector. However, the connector 108 may be any connector that allows a cutter tool 110 and a vacuum 112 to extend into the aperture 106*n* such as a quick connect coupler.

The cutter tool 110 may be connected to a pressure gauge at a first end (not shown) to allow a stream of fluid pressure, air pressure, or a combination of air and fluid pressure to flow of a second end (not shown) in the direction of arrow A. The cutter tool 110 extends into the connector 108 and through to the bottom of the aperture 106*n*. In use, a stream of fluid pressure, air pressure, or a combination of both will flow out of the cutter tool 110 pipe and through to the bottom of the aperture 106*n* such that it extends beyond the bottom 104 of the panel 100. The cutter tool 110 may be a high pressure rotating jet that is able to cut the soil or levee material. Although the pressure of the stream will depend on the material composition of the levee, the pressure stream may be about 5000 psi if the levee is comprised of peat material. The fluid pressure flowing out of the cutter tool 110 contacts the levee and transforms the levee composition into slush.

The slush may then be sucked out of the aperture by a vacuum 112 in the direction of arrow B. The vacuum 112 may be connected to a pressure gauge at a first end (not shown) to allow a user to control the vacuum pressure. The second end of the vacuum 109 may extend through to the end of the aperture 106*n* such that it extends beyond the bottom 104 of the panel 100. However, the second end 109 of the vacuum may extend to any length within the connector 108 or within aperture 106*n* and not extend beyond the bottom 104 of the panel 100 as is necessary to function.

As the cutter tool 110 transforms the levee composition into slush and as the vacuum 112 removes the slush, an opening, cavity, or pathway would be formed in the levee with the same relative dimensions as the levee barrier panel 100. Thus, as the cutter tool 110 cuts the soil, reducing the overall strength of the levee, the vacuum 112 removes the soil cuttings and eliminates pore pressure in the surrounding soil allowing for the soil and levee barrier panel 100 substitution. This allows for a more efficient and safer way to insert panels into the levee without the use of a pile driver or vibratory hammers.

Figure 2:
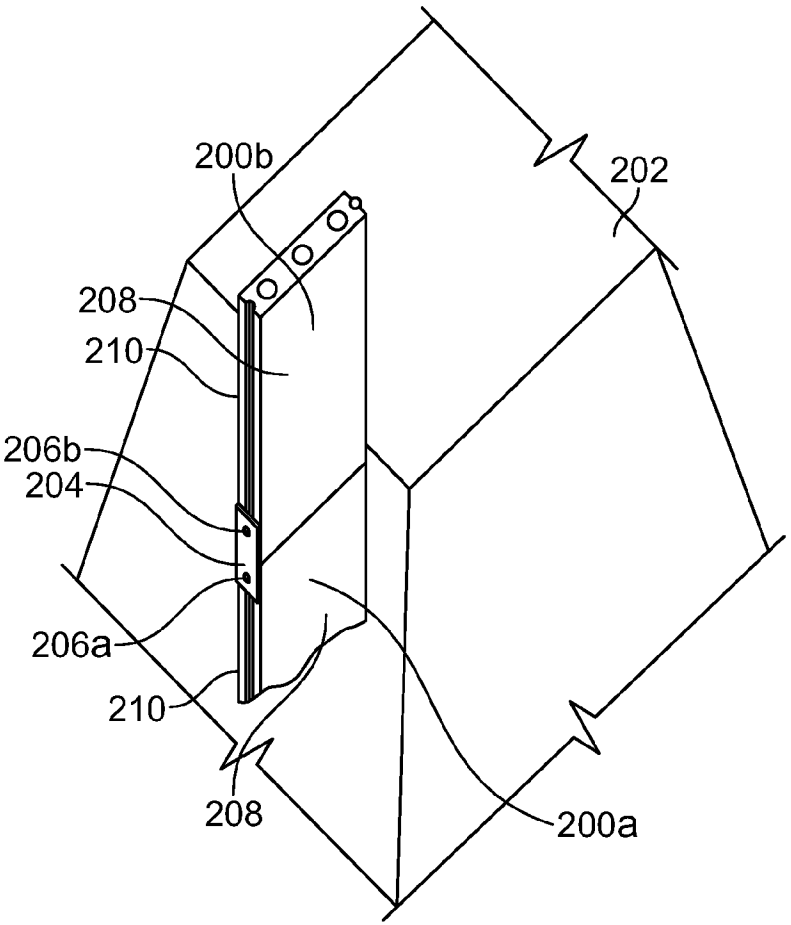
FIG. 2 illustrates the levee barrier panel positioned in a levee.

FIG. 2 illustrates the levee barrier panel positioned in a levee. The levee barrier panels 200*a*, 200*b* are illustrated in solid lines to better illustrate the invention, but it will be appreciated that the panels 200*a*, 200*b* are positioned within the levee 202. The levee barrier panel 200*a*, 200*b* may be positioned in any part of the levee 202, however, to form the retaining wall it may be positioned in the center of the levee 202. By positioning the retaining wall in the center of the levee, any burrowing animals will not be able to break the levee.

Figure 3:
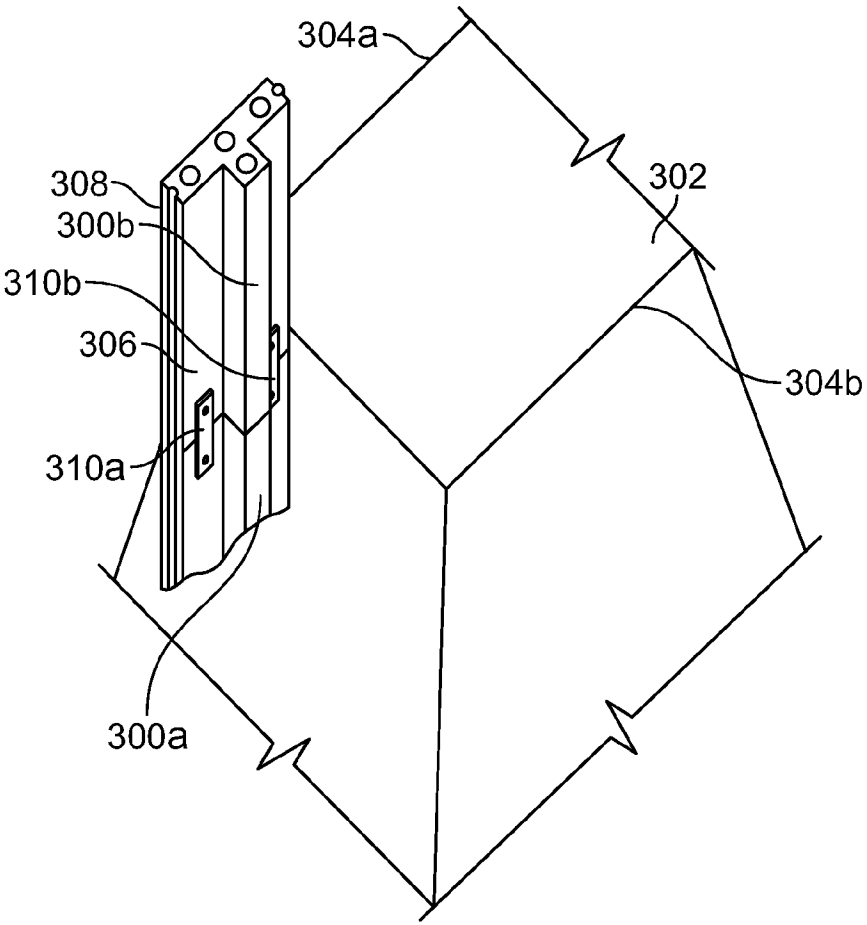
FIG. 3 illustrates another embodiment of a levee barrier panel.

The length of the levee barrier panels 200*a*, 200*b* may be any length necessary, however, is typically about 30-40 feet. Thus, an attachment member 204 may be used to laterally connect the panels 200*a*, 200*b* together. Although only one attachment member 204 is illustrated, the attachment member may also be positioned on the opposite side of the panel. Furthermore, although illustrated positioned on the side of the panel 200*a*, 200*b*, the attachment member 204, may be positioned on the front 208 and/or back 210 of the panels 200*a*, 200*b* as illustrated in FIG. 3. The attachment members 204 may be attached to the panels 200*a*, 200*b* by any means such as adhesives, screws, bolts 206*a*, 206*b*, or other similar materials.

FIG. 3 illustrates another embodiment of a levee barrier panel. The levee barrier panels 300*a*, 300*b* are illustrated in solid lines to better illustrate the invention, but it will be appreciated that the panels 300*a*, 300*b* are positioned within the levee 302. The panels 300*a*, 300*b* are formed in the shape of a "T" to retrofit the levee 302 for earthquakes. The attachment members 310*a*, 310*b* may be attached to the front 306 and/or the back 308 of the panels 300*a*, 300*b*. As illustrated, the panels 300*a*, 300*b* may be positioned on the edge of the levee 304*a* or at any position necessary to provide reinforcement for the levee 302. Alternatively, the levee barrier panels may be positioned on both sides 304*a*, 304*b* of the levee. In another embodiment, the levee may be reinforced with levee barrier panels 300*a*, 300*b* on both sides of the levee and with levee barrier panels 200*a*, 200*b* in the center of the levee.

Figure 4:
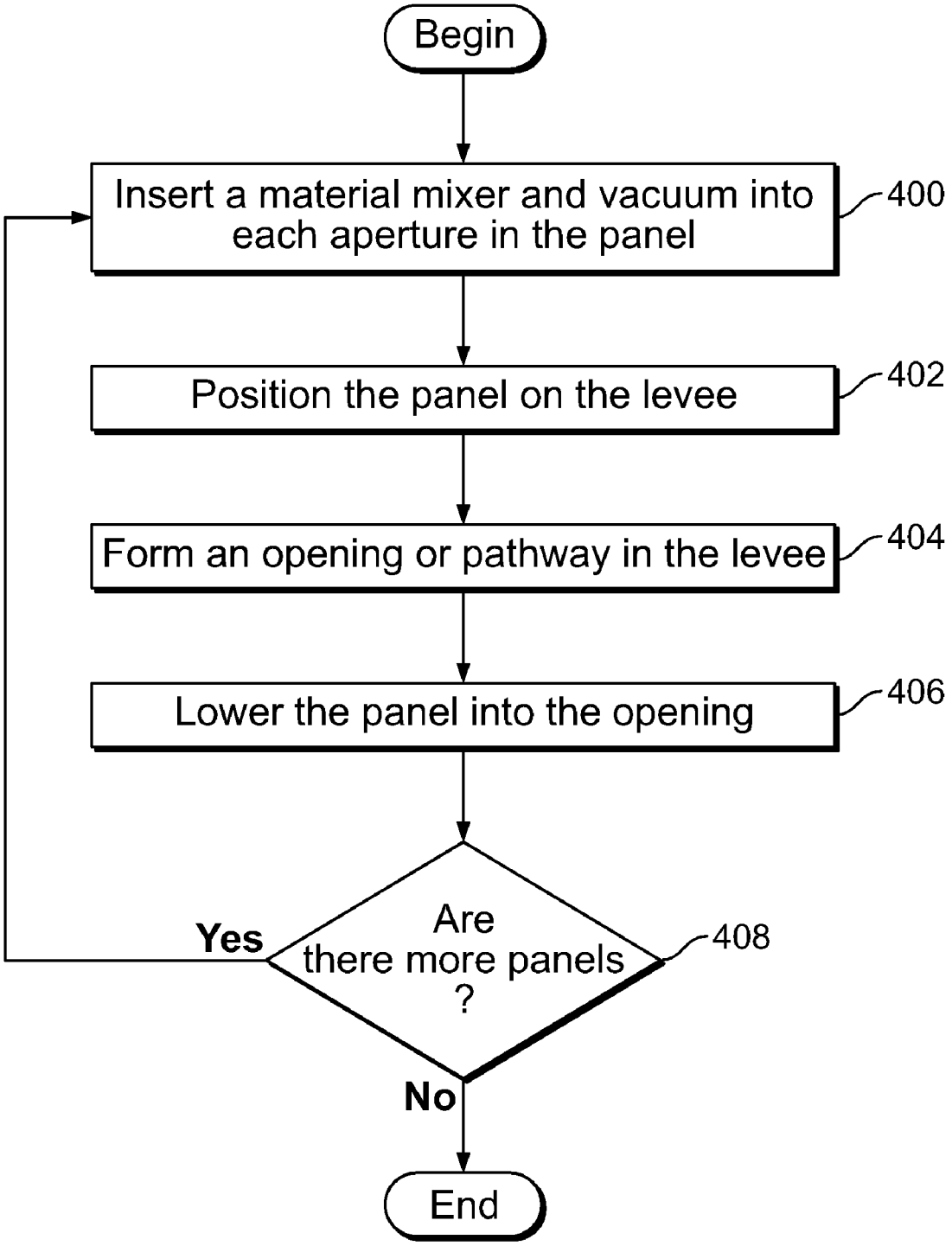
FIG. 4 illustrates a method for forming a levee retaining wall having a plurality of levee barrier panels.

FIG. 4 illustrates a method for forming a levee retaining wall having a plurality of levee barrier panels. Each levee barrier panel has a top, a bottom, and a plurality of apertures extending from the top to the bottom. A cutter tool and vacuum may be inserted into each aperture in the panels at 400.

The cutter tool may be connected to a pressure gauge to allow a stream of fluid pressure, air pressure, or a combination of air and water pressure to flow out of the cutter tool and through the bottom of the panel. Although the pressure of the flow will depend on the material composition of the levee, the pressure stream should be about 5000 psi if the levee is comprised of peat material.

The panel is positioned on the levee at 402. The fluid pressure flowing out of the cutter tool through the bottom of the panel contacts the levee and transforms the levee composition into slush. The slush may then be sucked out of the aperture by the vacuum which may also be connected to the pressure gauge to allow a user to control the vacuum pressure. Thus, as the cutter tool transforms the levee composition into slush and as the vacuum removes the slush, an opening or pathway would be formed in the levee at 404. The panel is then lowered into the opening at 406 to form the retaining wall. If there are more panels at 408, the panels are then positioned on the levee at 402.

EXAMPLE 1

Figure 5:
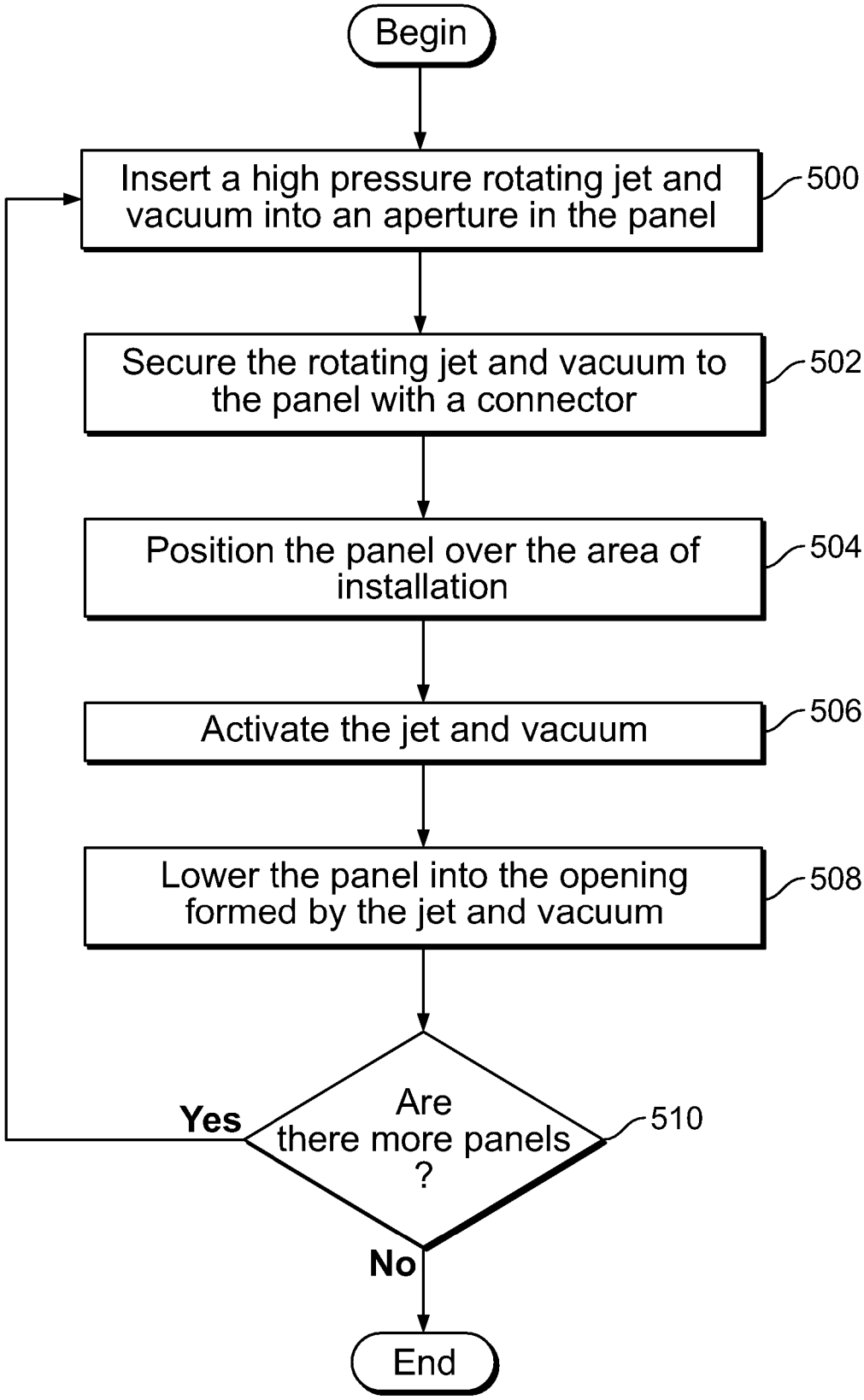
FIG. 5 illustrates a example of the method for forming a levee retaining wall.

FIG. 5 illustrates an example of the method for forming a levee retaining wall. The example is for exemplary purposes and not intended to be limiting. At 500, a high pressure rotating jet and vacuum are inserted into an aperture of the panel. The rotating jet and vacuum are secured to the panel with a connector at 502. The panel is then positioned over the area for installation at 504. The jet and vacuum are activated at 506 once the panel is positioned between about 5-15 inches above the existing grade on the levee. The panel is then lowered into the opening formed in the levee 508 by the jet and vacuum. As the panel is lowered, the distance of between about 5-15 inches between the bottom of the panel and the levee soil should be maintained. If there are more panels at 510, the method is repeated at 500.

While embodiments and applications of this invention have been shown and described, it would be apparent to those skilled in the art having the benefit of this disclosure that many more modifications than mentioned above are possible without departing from the inventive concepts herein. The invention, therefore, is not to be restricted except in the spirit of the appended claims.

What is claimed is:

1. A barrier panel system, comprising:

a panel having a top, a bottom, and side members;

at least one aperture within the panel extending from the top to the bottom of the panel;

at least one cutter tool removably attached to the panel, the at least on cutter tool comprising a cutter tool pipe that extends into the at least one aperture and delivers a pressurized stream out of the end of the cutter tool pipe to affect ground matter; and at least one vacuum tube removably attached to the at least one aperture which extends into the at least one aperture, wherein the at least one vacuum tube removes the affected ground matter through the aperture simultaneously with the delivery of the pressurized stream to automatically lower the at least one panel into the ground.

2. The barrier panel system of claim 1 further comprising a connector member to connect the at least one cutter too and the at least one vacuum tube to the at least one aperture.

3. The barrier panel system of claim 2 wherein the at least one connector member is a Y-connector.

4. The barrier panel system of claim 1 wherein the at least one cutter tool and the at least one vacuum tube further comprises a pressure gauge.

5. The barrier panel system of claim 1 wherein the pressurized stream is a stream of fluid pressure.

6. The barrier panel system of claim 1 wherein the pressurized stream is a stream of air pressure.

7. The barrier panel system of claim 1 wherein the pressurized stream is a stream of air pressure and fluid pressure.

8. The barrier panel system of claim 1 wherein the side members comprise a side attachment member and a corresponding side mating member to laterally attach other said panels, wherein the side attachment member comprises a cylindrical lock that extends out from the panel and the side mating member comprises a notched configuration that receives the cylindrical tock from another panel.

9. The barrier panel system of claim 1 wherein the at least one cutter tool comprises a rotating jet.

10. A method of installing a retaining wall having at least one panel, comprising:

attaching at least one removable cutter tool to an aperture in the at least one panel, the at least one cutter tool comprising a cutter tool pipe that extends into the aperture and delivers a pressurized stream out of the end of the cutter tool pipe to affect ground matter;

attaching a removable vacuum tube to the panel within the aperture;

positioning the at least one panel at a desired location;

cutting ground material with the pressurized stream from the at least one cutter tool; and removing the ground material out of the aperture with the vacuum tube to automatically lower the at least one panel into the ground.

11. The method of claim 10 wherein the pressurized stream comprises a stream of fluid pressure.

12. The method of claim 10 wherein the pressurized stream comprises a stream of air pressure.

13. The method of claim 10 wherein the pressurized stream comprises a stream of air pressure and a stream of fluid pressure.

14. The method of claim 10 further comprising controlling the pressure of the cutter tool and the vacuum tube.

15. The method of claim 10 further comprising securing the at least one cutter tool and the vacuum tube to the at least one panel with at least one connector member.

16. The method of claim 15 wherein the at least one connector member is a Y-connector.

17. The method of claim 10 wherein the at least one cutter tool comprises a rotating jet.

18. An apparatus for installing a retaining wall having at least one panel, comprising:

means for attaching a cutter tool to an aperture in the at least one panel, the at least one cutter tool comprising a cutter tool pipe that extends into the aperture and delivers a pressurized stream out of the end of the cutter tool pipe to affect ground matter;

means for attaching a vacuum tube to the aperture;

means for positioning the at least one panel on the levee;

means for affecting ground matter with the cutter tool; and means for removing the affected ground matter out of the aperture simultaneously with said means for affecting ground matter to automatically lower the at least one panel into a ground.

19. The apparatus of claim 18 wherein said means for affecting further comprises means for discharging a stream of fluid pressure.

20. The apparatus of claim 18 wherein said means for affecting further comprises means for discharging a stream of air pressure.

21. The apparatus of claim 18 wherein said means for affecting further comprises means for discharging a stream of air pressure and a stream of fluid pressure.

22. The apparatus of claim 18 further comprising means for controlling the pressure of the cutter toot and the vacuum.

* * * * *